United States Patent [19]

Arieh et al.

[11] Patent Number: 4,614,047

[45] Date of Patent: Sep. 30, 1986

[54] SKI BOOT CLOSING AND TIGHTENING APPARATUS

[75] Inventors: Simon Arieh; Guy Courvoisier, both of Geneva, Switzerland

[73] Assignee: Lange International S.A., Fribourg, Switzerland

[21] Appl. No.: 725,258

[22] Filed: Apr. 19, 1985

[30] Foreign Application Priority Data

May 2, 1984 [CH] Switzerland ..... 2128/84

[51] Int. Cl.[4] ..... A43B 11/00; A43B 5/04

[52] U.S. Cl. ..... 36/50; 36/117; 24/68 SK; 24/274 R; 24/70 SK

[58] Field of Search ..... 36/117–121, 36/50; 24/68 SK, 68 B, 69 SK, 70 SK, 71 SK, 274 R, 274 P, 274 WB

[56] References Cited

U.S. PATENT DOCUMENTS

| | | | |
|---|---|---|---|
| 303,039 | 8/1884 | Pearson | 24/274 R |
| 1,397,508 | 11/1921 | Gillet | 24/274 R |
| 2,345,832 | 4/1944 | Pritchard | 24/274 P |
| 3,662,435 | 5/1972 | Allsop | 24/70 SK |
| 4,326,320 | 4/1982 | Riedel | 36/50 X |

FOREIGN PATENT DOCUMENTS

| | | | |
|---|---|---|---|
| 0073989 | 3/1983 | European Pat. Off. . | |
| 3013953 | 10/1981 | Fed. Rep. of Germany | 24/69 SK |
| 1256422 | 2/1961 | France | 24/274 R |
| 2180250 | 11/1973 | France . | |

*Primary Examiner*—James Kee Chi

*Attorney, Agent, or Firm*—Brumbaugh, Graves, Donohue & Raymond

[57] ABSTRACT

The ski boot is closed by a device acting both as a closing and a tightening device. This device comprises a worm-screw mounted in one of the two portions of the boot and cooperating with a cogged strap rigid with the other portion, the cogged strap being kept in meshing engagement with the worm-screw by guide means adapted to be moved away from the strap for releasing same or quickly bringing a selected portion of the strap in front of the worm-screw.

9 Claims, 8 Drawing Figures

SKI BOOT CLOSING AND TIGHTENING APPARATUS

BACKGROUND OF THE INVENTION

The present invention relates in general to ski boots and has specific reference to ski boot of the type comprising at least two portions with overlapping edges for surrounding the foot or ankle of the skier, and at least one closing and tightening device for interconnecting these two portions, this device comprising a cogged or perforated strap or belt secured to one of said boot portions and adapted to cooperate with hooking and tightening means carried either by the same portion or by the other portion of the boot.

THE PRIOR ART

A device of this type is known through the French Pat. No. 2,180,250. In this prior art device the strap or belt is cogged and cooperates on the one hand with tightening means consisting of a one-way reciprocating driving device and on the other hand with a holding pawl, this assembly operating like a lifting jack. Therefore, the stretching and hooking means are perfecting separate and operate independently of each other. However, this known device is rather complicated and cumbersome, and furthermore it is not always easy to operate. In fact, to release the belt the operator must firstly release the holding pawl, and this step may require a considerable effort when the strap is highly stretched. Moreover, the strap tension adjustment can only take place tooth by tooth and the teeth must have a predetermined minimum size in order to warrant a reliable holding. In addition, the tension control lever provides only a reduced leverage, so that beyond a certain tension value its actuation requires abnormally high efforts.

SUMMARY OF THE INVENTION

It is the primary object of the present invention to provide a device of the type broadly set forth hereinabove, but considerably simpler, less cumbersome and requiring only a minimum force for its actuation.

The ski boot according to the instant invention is chacaracterized by the fact that the cogged strap is provided with helical teeth and that the hooking and stretching means consist of a worm-screw secured to the other portion of the boot, said worm-screw extending in the direction of the strap and being provided with manual control means, and that guide means are provided for keeping the cogged strap in constant meshing engagement with the worm-screw, pivot means being also provided for disengaging the cogged strap from the worm-screw or vice-versa.

It is already known to use a worm-screw as a stretching member (European Patent Application No. 0 073 989). In this case, the screw cooperates with a tightening strap provided within the boot. However, this worm-screw cannot be used as a hooking means and the strap cannot be moved away from the worm-screw.

In the closing and tightening device according to the present invention, the stretching and hooking means consist of the same member, that is, the worm-screw. This device has particularly reduced over-all dimensions, for the worm-screw and its shank extend parallel to the boot surface and the worm-screw proper can be embedded in the boot material.

By using a worm-screw a very fine adjustment can be made, if desired, this adjustment being continuous if the screw is actuated directly by means of a knurled knob or a capstan head, or a pawl-and-ratchet device. Moreover, the strap tension is adjustable in both stretching and release directions, for example when it is desired to untighten an excessively tight boot.

In a preferred form of embodiment of the invention, the strap guide means are releasable to permit a quick insertion of the strap between the worm-screw and the released guide means, the guide means being subsequently restored to their operative position and locked in this position by suitable means in order to keep the strap cogs in driving engagement with the threads of the worm-screw.

In a different form of embodiment of the ski boot buckle, the worm-screw is rotatably mounted in a support adapted to pivot in relation to the boot and provided with a lever having pawl means in direct and constant engagement with teeth formed on the screw threads.

DESCRIPTION OF THE PREFERRED EMBODIMENTS

Figure 1:
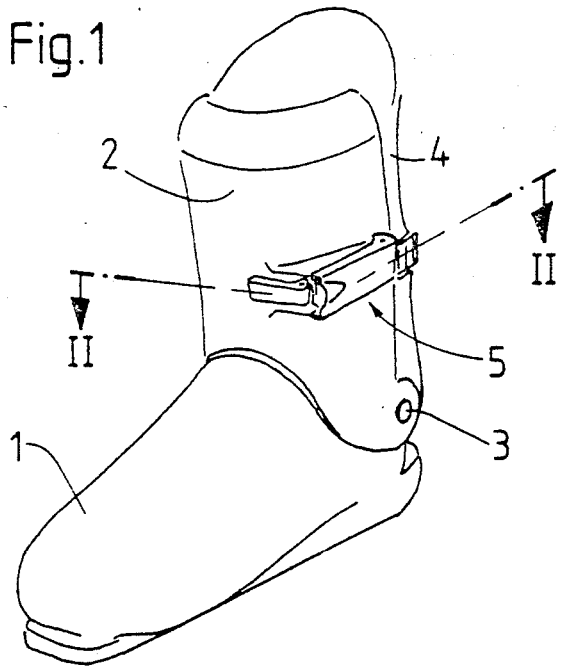
FIG. 1 is a perspective view of a ski boot to be put on from the rear, provided with a buckle or fastener according to a first form of embodiment of the present invention.

The ski boot illustrated in FIG. 1 comprises a shell or vamp 1 rigidly connected to the sole and adapted to surround the foot, the heel and the front lower portion of the ankle, and an upper or leg comprising a front, channel-shaped and rearwardly opening portion 2 secured in the known fashion to the shell 1 substantially at the malleolus level, for example at two opposed points such as 3, about which this portion 2 can pivot to a moderate extent. The upper further comprises a rear portion 4 also of channel configuration, pivoted about the same pivot means 3 as the front portion 2. This rear portion 4 is adapted to fit into the front portion 2 to permit the insertion of the skier's foot into the boot. These various component elements are made of conventional synthetic resin.

Figure 2:
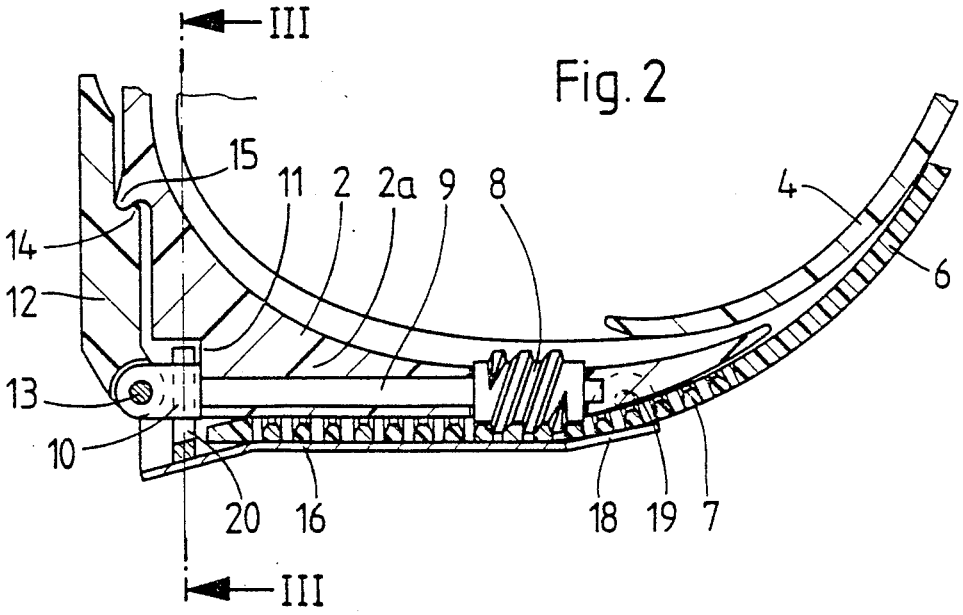
FIG. 2 is a fragmentary section taken along the line II—II of FIG. 1.
Figure 3:
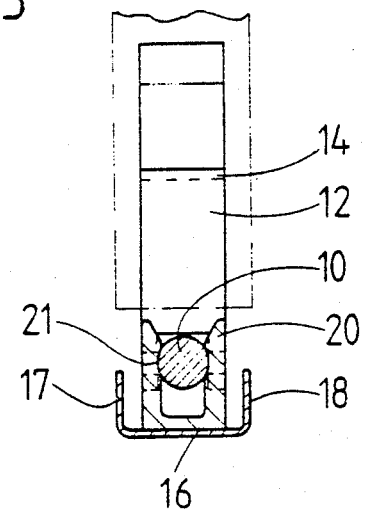
FIG. 3 is another section but taken along the line III—III of FIG. 2.
Figure 4:
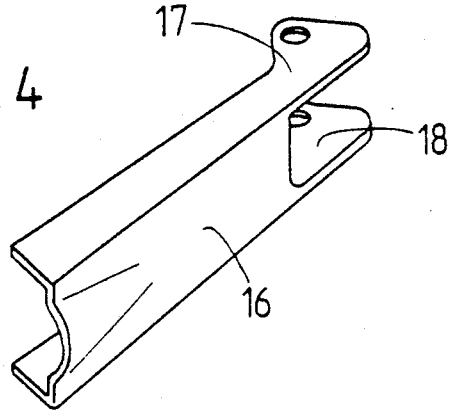
FIG. 4 is a perspective view of the guide member.

The connecting and tightening device 5 is shown more in detail in FIG. 2. This device 5 comprises a strap 6 secured to the front portion 2 of the upper, made for example of the same material as the upper and either fastened thereto or formed integrally by molding therewith. This strap 6 is adapted to fit around the upper rear portion 4. One face of strap 6 has formed thereon helical teeth 7 corresponding to and adapted to cooperate with the threads of a worm-screw 8 housed in a recess formed in the front portion 2 of the upper and rigid with a shank 9 housed in a thicker portion 2*a* of said front upper portion 2. The outer end of shank 9 is provided with a cylindrical head 10 of a diameter somewhat greater than that of said shank 9 and adapted to react against a flat surface 11 formed on said thicker portion 2a. The head 10 is yoke-shaped and adapted to receive one end of a crank 12 pivotally connected to this yoke by means of a pin 13. The crank 12 comprises a transverse groove 14 adapted snappily to engage a corresponding rib or similar projection 15 formed on the front portion 2 of the upper when the device is in its inoperative position.

This form of embodiment of the connecting and tightening device of the present invention further comprises a guide member 16 in the form of an elongate rectangular U-sectioned member, preferably of pressed metal, having parallel wings 17 and 18 pivotally mounted in the thicker portion 2a of the rear upper by means of a pin 19 located close to the inner end of shank 9. A fork-shaped, two-prong clip 20 is secured close to the free end of lever 16, each tooth of this clip comprising an inner rounded notch 21 adapted to engage the cylindrical head 10 when the lever 16 is folded back to the boot as illustrated in the drawings. In this position the gap left between the lever 16 and the worm-screw 8 is just sufficient to permit the insertion of the strap whereby the cogs 7 of this strap are safely kept in meshing engagement with the worm-screw 8. The teeth 7 have a trapezoidal cross-sectional contour and the threads of screw 8 have a matching contour, as illustrated, so that in operation a force component develops which urges the lever 16 away from the screw 8. However, this component is relatively weak and on the other hand the torque exerted about the pin 19 is relatively low in comparison with the distance between this pin 19 and the point where the lever 16 is retained on the shank head 10.

Besides, it should be possible to dispense with this component by providing a tooth contour having a bearing face perpendicular to said lever 16.

From the position shown in the drawings (FIGS. 1 and 2), to take off his boot the skier firstly pulls the lever 16 away from the boot to free the teeth 7 and consequently the belt 6 from the worm-screw 8, so that the boot can be opened almost instantaneously. When putting the boot on, the belt 6 is inserted as far as possible between the open lever 16 and the screw 8, whereafter the lever 16 is restored to its operative position against the boot. Thus, the belt 6 is in meshing engagement with the worm-screw 8. Then, the crank 12 is released from the retaining rib 15 and the screw 8 is rotated until the desired tightness is obtained, and eventually the crank 12 is folded back against the boot.

If desired, a knurled knob or a capstan head secured to the outer end of shank 9 may be substituted for the crank 12. Thus, a continuous adjustment of the strap tension can be made.

Figure 5:
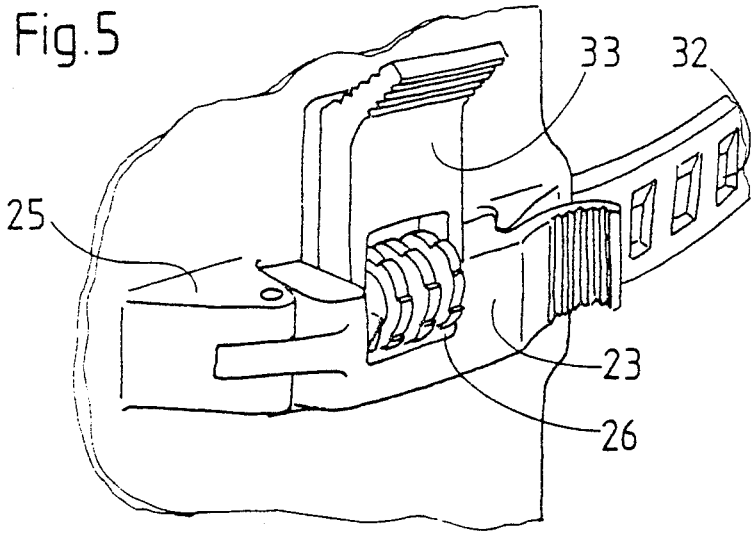
FIG. 5 is a perspective view of a second form of embodiment of the invention.
Figure 6:
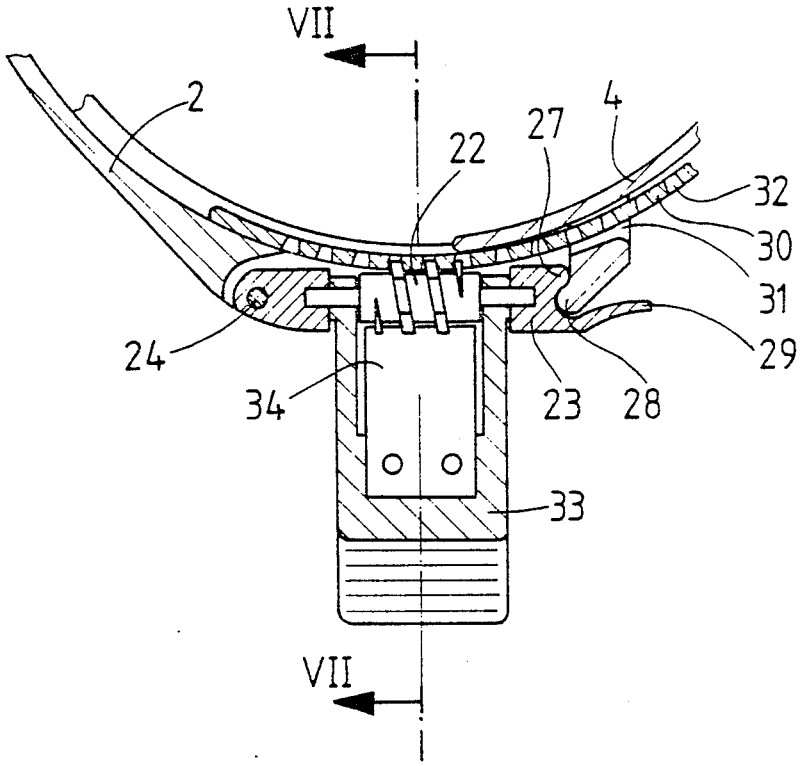
FIG. 6 is a section taken along the axis of the worm-screw of FIG. 5.
Figure 7:
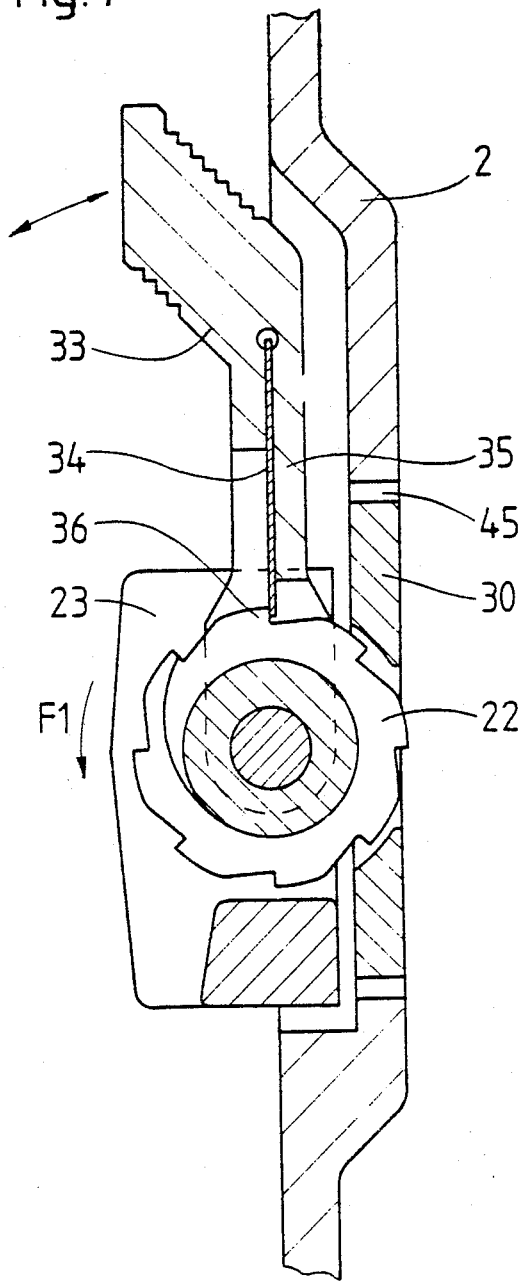
FIG. 7 is a section taken along the line VII—VII of FIG. 6.

In the second form of embodiment of the invention, illustrated in FIGS. 5, 6 and 7 of the drawings, the worm-screw 22 is pivotally mounted in a support 23 pivoted in turn about a pin 24 carried by a boss 25 formed integrally with the front portion 2 of the upper. More particularly, the worm-screw 22 is rotatably mounted in an aperture 26 formed in said support 23. This support 23 is normally retained in its boot-engaging position by a rib 27 adapted to be snappily engaged in a matching groove formed beyond a projection 28 formed integrally with the upper 2. The end 29 of support 23 is shaped to facilitate the actuation of this support 23 in both opening and closing directions. The perforated strap 30 is guided by a passage 31 formed in the upper 2 of the ski boot under the aforesaid projection 28. This passage has a groove-like extension under the support 23 so tht the worm-screw 22 will mesh with the holes 32 in the fold-down position of said support, this meshing engagement taking place through an aperture 46 formed in the boot upper 2.

Also pivotally mounted by means of the pin of said worm-screw 22 on said support 23 and in the aperture 26 thereof is a lever 33 provided with a pawl 34 consisting of spring blade having one end inserted in a slit of lever 33 and engaging with one face a bearing surface 35 of said lever 33 (FIG. 7), the other face being free. The pawl 34 cooperates with ratchet teeth 36 cut directly in said worm-screw 22.

This closing and tightening device operates as follows: the support 23 being initially and preferably disengaged from the upper 2, the perforated strap 30 is inserted as far as possible through the passage 31, whereafter the support 23 is pivoted back to its operative position. Then it is only necessary to actuate the lever 33 up and down for rotatably driving the worm-screw 22 unidirectionally in the direction of the arrow F1. When the desired tension is obtained, the lever 33 is folded to the position shown in FIGS. 5 and 7. To open the boot, the skier just lifts the support 23 to release the strap 30.

With this device the strap tension can be adjusted substantially continuously. This device is particularly compact and easily actuatable. Furthermore, the strap end is concealed under the front portion 2 of the upper.

Figure 8:
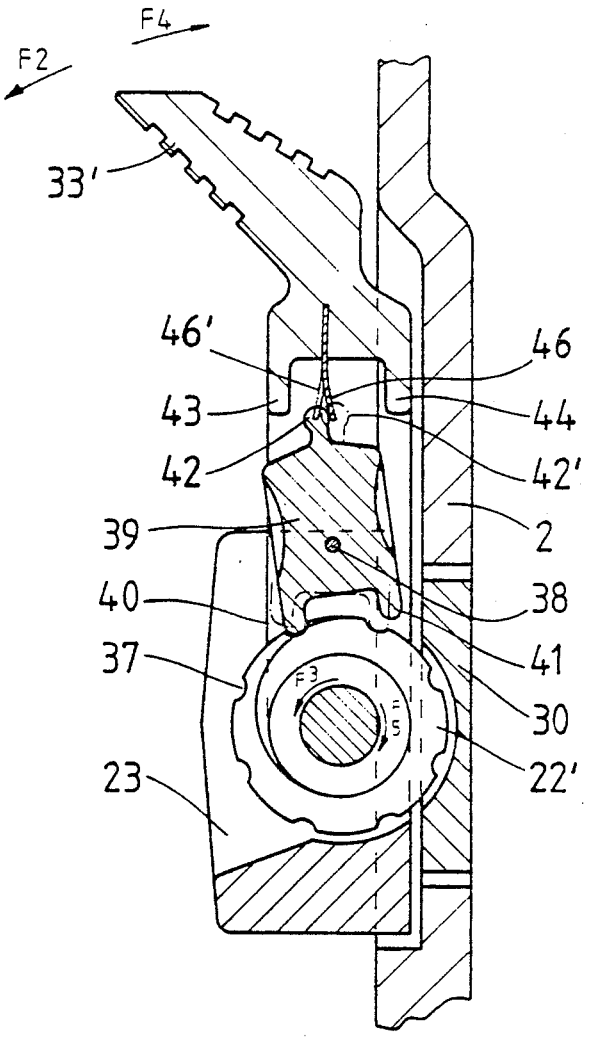
FIG. 8 is a section similar to FIG. 7 showing a modified version of the second form of embodiment.

In a modified form of embodiment of the above-described device, the worm-screw can be driven in one or the other direction. This modified form of embodiment is illustrated in FIG. 8, which is a sectional view similar to that of FIG. 7. The component elements omitted in this FIG. 8 are the same as those shown in FIGS. 5 and 7, the similar component elements being designated by the same reference symbols. The lever 33 and the worm-screw 22 have a different configuration and are designated by reference numerals 33' and 22', respectively. The worm-screw 22' has round-sectioned notches 37 formed at spaced angular intervals along its outer periphery. Pivoted to lever 33' by means of a pin 38 is a bistable rocker-like pawl 39 provided with two round sectioned projecting beads 40,41 adapted to engage the rounded notches 37 of worm-screw 22' and thus to rotatably drive this worm-screw. The pawl 39 has a rounded head 42 opposite the beads 40,41 which projects into the gap formed between a pair of stop members 43 and 44 formed integrally with said lever 33'. The free end of a spring blade 46 fitted in a slit of lever 33' and extending towards the pivot pin 38 resiliently engages said head 42, in a position intermediate said stop members 43 and 44. This spring blade 46 constantly urges the rocker pawl 39 in one or the other of two stable end positions, one of these stable positions being shown in FIG. 8. In this position, one of the pawl beads, in this case head 40, bears against the worm-screw 22' and the spring blade 46 is slightly deflected.

In the position illustrated in FIG. 8, if the skier actuates the lever 33' in the direction of the arrow F2, the worm-screw 22' tends to hold the rocker pawl 39 so that its bead 40, in case it were not already engaged in one of the worm-screw notches 37, will engage this one notch. However, the spring blade 46, which may be made from a strip of synthetic resin, is too weak to cause the worm-screw to rotate and moves to the other side of said head 42, that is, on the left side thereof, as seen in FIG. 8. Under these conditions, the head 42 will be moved substantially to the position shown in dash lines 42', the spring blade 46, in this position 46', bearing against the other side of head 42 thus causing the other bead 41 of the pawl to engage the worm-screw 22'. As the movement of lever 33' in the direction of the arrow F2 continues, the stop member 44 hits the head 42 and as the pawl 39 is stopped on lever 33', it causes its bead 40 to rotate the worm-screw 22', in the direction of the arrow F3. When the control lever 33' is allowed to move back to its initial position (in the direction of the arrow F4), the reverse movement is obtained, in that the head 42 resumes its position on the left-hand side of spring blade 46. If the skier continues to move the lever 33' in the same direction F4, it is the left-hand stop member 43 that hits the head 42 so that the worm-screw 22' will be driven in the clockwise direction F5. If on the other head the movement of control lever 33' in the direction F4 is stopped immediately when a certain resistance is felt and the lever is then moved in the direction F2, the worm-screw 22' will again rotate in the same direction F3. Thus, by causing a so-called "pumping" movement of lever 33', the user can drive at will the worm-screw 22' in one or the other direction, so that the strap 30 can be tightened or released at will and continuously.

Of course, this invention should not be constructed as being strictly limited by its application to a boot to be put on from its heel end, as described hereinabove by way of example, since this device is applicable to all types of boots. Thus, the worm-screw closing and tightening device may be substituted notably for any known type of buckles.

What is claimed is:

1. A ski boot comprising at least two portions having overlapping edges for surrounding the leg or ankle and at least one closing and tightening device for interconnecting said two portions, said device comprising a cogged strap secured to one of said boot portions and adapted to cooperate with hooking and tightening means secured to the same boot portion or to the other boot portion, wherein said cogged strap comprises helical teeth and said hooking and tightening means consists on the one hand of a worm-screw extending along said strap and having manual actuating means, and on the other hand of means for guiding said cogged strap in meshing engagement with said worm-screw, pivot means being further provided for moving said cogged strap away from or toward said worm-screw.

2. The ski boot of claim 1, wherein said guide means consist of a U-sectioned lever fulcrumed about an axis located beyond said worm-screw, fastening means being provided on said guide member and said boot for retaining said lever in its fold-down position.

3. The ski boot of claim 2, wherein said means for fastening said guide member consist of a clip rigid with said U-sectioned lever and adapted to be secured to the shank of said worm-screw between said worm-screw actuating means and said boot.

4. The ski boot of claim 3, wherein said worm-screw and said shank are mounted inside a thicker area of one of the two portions of the boot.

5. The ski boot of claim 1, wherein said worm-screw actuating means consist of a crank pivoted to the outer end of said worm-screw shank and provided with a notch snappily engageable by a bead formed on said boot for holding said crank in its inoperative position.

6. The ski boot of claim 1, wherein said worm-screw actuating means consist of a knurled knob or capstan head.

7. The ski boot of claim 1, wherein said worm-screw is mounted in a support pivotally mounted to one boot portion and adapted to be resiliently held in bearing engagement with this boot portion by detent positioning means, said boot portion comprising an aperture registering with said worm-screw and through which said worm-screw is adapted to mesh with said cogged strap engaged under said boot portion, said strap guide means consisting of a strap passage formed in the thickness of said boot portion, said manual means for actuating said worm-screw consisting of a lever fulcrumed on the end arbors of said worm-screw and provided with a pawl cooperating with notches formed on said worm-screw so as to rotatably drive said worm-screw when said lever is rotated alternatively in one and the other direction.

8. The ski boot of claim 7, wherein said notches have a pawl-teeth configuration and said pawl consists of a spring blade retained by a bearing surface of said lever on the side opposite the worm-screw driving direction, whereby the worm-screw can be driven unidirectionally.

9. The ski boot of claim 7, wherein said pawl consists of a bistable rocker-like member provided with beads and fulcrumed to said lever and provided with a head opposite said beads, said head being engageable between a pair of stop members formed on said lever and between which said head is held in one or the other of its stable positions by one end of a spring blade, said one stable position causing one of said rocker pawl beads to be urged against said worm-screw, whereby said worm-screw can be driven either in one direction or in the other direction by one or the other of said lever beads, respectively.

* * * * *